United States Patent [19]

Kodatsky et al.

[11] Patent Number: 4,753,676

[45] Date of Patent: Jun. 28, 1988

[54] METHOD OF DESULFURIZING IRON

[75] Inventors: William K. Kodatsky, Mississauga; Anton Mueller, Welland; Ararat Hacetoglu, Fonthill; Bruce J. Barker, Niagara Falls, all of Canada

[73] Assignee: American Cyanamid Company, Stamford, Conn.

[21] Appl. No.: 99,046

[22] Filed: Sep. 21, 1987

[30] Foreign Application Priority Data

Feb. 13, 1987 [CA] Canada ..... 529662

[51] Int. Cl.[4] ..... C21C 7/02

[52] U.S. Cl. ..... 75/53; 75/58

[58] Field of Search ..... 75/53, 58

[56] References Cited

U.S. PATENT DOCUMENTS 4,049,442 9/1977 Freissmuth ..... 75/53

4,242,126 12/1980 Freissmuth ..... 75/53

*Primary Examiner*—Peter D. Rosenberg

*Attorney, Agent, or Firm*—Frank M. Van Riet

[57] ABSTRACT

Iron is desulfurized with a compacted article composed of calcium carbide and a gas-generating solid whereby the article is disintegrated during desulfurization resulting in a substantial total consumption of the carbide and a resultant decrease of residual carbide in the slag produced.

15 Claims, No Drawings

METHOD OF DESULFURIZING IRON

BACKGROUND OF THE INVENTION

The desulfurization process employed for molten iron is significantly different in foundries from that utilized in integrated steel mills. The scale of the two processes has led to materially different approaches to the desulfurization thereof by the two industries.

Whereas integrated steel mills, for the most part, batch desulfurize about 50–300 ton batches of hot iron by injecting 400 mesh powders 6–10 feet below the iron surface using a lance and a carrier gas, foundry desulfurization normally entails the surface addition of from about 8 to about 80 mesh powders to dwell units of from about 1–10 ton units of hot iron. Foundry desulfurization may be performed in batch, semi-continuous or continuous fashion.

The injected powder in the integrated steel mill desulfurization process typically contains a reducing gas-generating additive which may also assist in the desulfurization of the metal. An example of such an additive is magnesium. The gas-generating additive in this type of process performs the necessary stirring function to enable homogeneous desulfurization in the large capacity integrated mill desulfurizing vessel. Because surface addition of the desulfurizing agent is used in foundry desulfurization of iron, a gas-generating additive is not necessary and is very infrequently used for stirring. In the absence of the gas-generated additive, the stirring function is performed by an extraneous stirring means such as porous plugs inserted into the bottom of the dwell unit through which nitrogen gas is bubbled or a mechanical paddle type of stirring mechanism.

A concise dissertation of the various procedures for desulfurizing iron can be found in Ductile Iron; Molten Metal Processing; Chap. 3; 2nd Ed. Published by the American Foundrymen's Society; Des Plains, Ill; 1986. Examples of procedures employed by the integrated mills are set forth in U.S. Pat. Nos. 3,885,956 and 3,929,464, hereby incorporated herein by reference.

The injection technology employed by the integrated mills has generally not been adopted for use by the foundries due to the high capital cost of the injection system relative to the pneumatic or gravity feed surface addition systems used by the foundries. Also insufficient ladle depth in the foundry dwell units does not make powder injection practical or efficient. Thus, surface addition of desulfurization reagents has been found to be the only viable alternative for foundries.

The requirements for foundry desulfurization reagents have been established over the years through economic, safety and environmental necessities. These reagents must:

1. be capable of effectively and efficiently removing sulfur from iron containing 0.015–0.1% or more sulfur to 0.010% or lower.
2. be sized within a narrow range of about 8 to 80 mesh, preferably about 10 to 35 mesh, and not contain excessive amounts of fines (to prevent eye and skin irritation) or coarse material (to insure good reagent efficiency and low residual calcuim carbide in the slag.)

These requirements have been reasonably satisfied by available commercial reagents in the past, however, an ever increasing environmental awareness has placed even more stringent requirements on foundries.

One of the most important environmental effects has been caused by residual calcium carbide in the slag resulting from the desulfurization process. When the slag contains large amounts of this material, disposal thereof is further complicated because calcium carbide has been determined to be a safety hazard.

The cause of residual calcium carbide in the slag has been determined to be the presence of large particles in the charged reagent which are not completely used up during the desulfurization reaction. The normal chemical reaction which occurs during the desulfurization of the molten iron is both the reaction of the calcium carbide with the sulfur in the metal to form calcium sulfide and carbon and the reaction of the calcium carbide with oxygen to form calcium oxide and carbon dioxide or carbon monoxide gas. All of these reaction products can be dealt with by the foundries by existing methods.

The problem arises when the calcium carbide of the larger particle size becomes coated with the calcium sulfide or calcium oxide reactants and is not completely reacted. This unreacted calcium carbide finds its way into the resultant slag and must be removed before disposal of the slag can be accomplished.

Attempts to overcome this residual calcium carbide slag problem have included utilizing very fine particles of calcium carbide as a charge so as to assure complete conversion thereof. However, the very essence of the foundry surface addition system prevents this solution because convection from the molten iron process per se carries the small unreacted particles away as does the suction from the fans over the dwell units required to dissipate fumes, dust etc. Thus, the use of fine particles results in a further safety hazard at the foundry and a large loss of material into the baghouse dust collection system.

Thus, the useful particle size of the calcuim carbide is virtually governed by the system employed and foundries have faced the residual calcium carbide problem by treating the slag through a controlled water addition to generate acetylene and thus reduce the carbide content of the slag. This extraneous water treatment, however, puts an additional burden on the foundry and creates a further expense not to mention the safety hazards of such, odor and dust generation and the water purification requirements which result. Thus, the existence of a system which eliminates or materially reduces the content of residual calcium carbide in the slag of foundry desulfurization would solve a continuing problem in the iron industry.

SUMMARY OF THE INVENTION

A means has now been found whereby the amount of residual calcium carbide in the slag which results from the desulfurization of molten iron utilizing the foundry surface addition system can be substantially reduced or even eliminated by the use of a compacted article consisting essentially of calcium carbide and an oxidizing gas-generating solid. The herein-described invention effectively resolves the environmental issues of residual $CaC_2$ in the slag while simultaneously addressing the constraints of particle size distribution and desulfurization efficiency.

The oxidizing gas-generating solid, in the solid article employed in the process hereof disintergrates the compacted article into many smaller particles upon contact with the heated surface in the dwell unit. Thus, very small particles are produced in situ in the dwell unit whereas they cannot be added as such to the metal surface per se. These small particles are substantially totally consumed either by the desulfurization of the iron forming CaS or by oxidation thereof forming CaO via the oxidation atmosphere enhanced by the gas-generating solid.

Various disclosures have set forth information related to the process of the present invention. For example, U.S. Pat. No. 4,010,028 discloses a process for desulfurizing metal with a compacted article containing $CaC_2$ and a binder additive. The article is shaped into non-circular shapes such as squares, rectangles, dumbbells, polygons, etc., for fitting onto the shaft of the stirrer whereby the binder disintegrates and the $CaC_2$ is left to desulfurize the metal.

Such a shaped article is impractical and/or not useful in a process wherein surface addition of the carbide is effected because, at the high temperature of the molten metal, the binder is rapidly disintegrated causing excessive metal surface flaming. Also, any large particles of $CaC_2$ thus created would subject the system to the same problems attendant the addition of unbound particles to the metal surface discussed above.

Other references teaching the use of binder-containing compacted articles of $CaC_2$ include Japan Pat. Nos. 49111812 and 49098717. The pitch or tar binders disclose also cause excessive surface flaming when added to molten metal.

Additionally, Japan Pat. Nos. 7634812; and 7554513 and U.S. Pat. No. 3,955,966 disclose the use of compacted $CaC_2/CaCO_3$ articles (with and without binders) for use in integrated steel mill systems, i.e. lance injection while Japan Pat. Nos. 50059300; 73084016 and 77012657 teach the use of compacted $CaC_2$ in the absence of a oxidizing gas-generating solid. Such systems have been found not to be as effective as the compacted articles used in the present invention as shown in the examples below.

Other attempts to induce slower dissipation of the $CaC_2$ are taught in Japan Pat. No. 52116714 wherein an iron coating is created on the $CaC_2$ particles and Japan Pat. No. 51073915 wherein metallic aluminum is used as a binder which deteriorates on heating to release the $CaC_2$ particles.

Japan Pat. No. 7565410 is exemplary of the systems wherein magnesium is compounded with $CaC_2$. While the magnesium creates gas, the gas is a reducing gas and consequently oxidation of the $CaC_2$ is retarded thereby.

DESCRIPTION OF THE INVENTION INCLUDING PREFERRED EMBODIMENTS

The present invention is directed to an improvement in the foundry desulfurization of iron. Thus, in a process wherein molten iron is desulfurized with a desulfurization additive by adding to only the surface of a body of the molten iron, particles of said additive in the presence of an extraneous agitating means and in the absence of a carrier gas for said particles which permeates the metal surface, the improvement comprises utilizing as the additive a compacted article consisting essentially of calcium carbide and sufficient amounts of an oxidizing gas-generating solid, whereby said article is disintegrated into smaller particles which are substantially completely consumed during desulfurization of the iron and whereby the presence of residual carbide in the resultant slag is minimized.

As discussed above, the crux of the process of the present invention is the use of a compacted article consisting essentially of calcium carbide and an oxidizing gas-generating solid. These articles, when contacted with the surface of hot molten iron, break down into particles of the calcium carbide upon generation of gas by the gas-generating solid. This breakdown occurs not only at the surface of the metal, but also after the article is immersed in the metal also because of the extraneous agitating means.

The term "consisting essentially of", as used herein in regard to the compacted article, means that it excludes various components which may deleteriously interfere with the function of the article upon addition to the molten metal. Thus, the term excludes deleterious amounts of such additives as binders such as tar, pitch, polymers, ores, etc. (although small amounts e.g., 1.0%, by weight, may be employed to enhance compaction), magnesium, metallic aluminum, iron coatings and the like.

The term "calcium carbide", as used herein, includes not only pure calcium carbide, but furnace grade or technical grade calcium carbide as is used in the industry. Furnace grade or technical grade calcium carbide comprises about 80% calcium carbide, 15% calcium oxide, 2% carbon, 1% calcium hydroxide and 2% misc. ingredients.

Diamide lime is a known material comprising about 85% calcium carbonate and about 11% carbon, remainder artifacs, in the form of graphite. It is a by-product of the production of dicyandiamide.

Furnace dust or collector dust is also a known material which usually comprises about 65% calcium hydroxide, about 20% calcium oxide and 15% calcium carbide.

The articles composed of calcium carbide and an oxidizing gas-generating solid may contain from about 55–99%, by weight, based on the total weight of the article, of calcium carbide and from about 1% to about 45%, by weight, same basis, of the oxidizing gas-generating solid. up to about 25%, by weight, same basis, of the calcium carbide can be replaced by furnace dust, collector dust, etc, so long as the final content of the carbide and gas-generating solid fall within the above-disclosed limits. The preferred amount of calcium carbide ranges from about 75% to about 95%, by weight, same basis, and the preferred amount of oxidizing gas-generating solid ranges from about 5% to about 25%, by weight, same basis.

The compacted articles used in the process of the present invention may be prepared in any way and with any size particles of calcium carbide and gas-generating solid as long as the resultant article breaks down into suitable size particles which are substantially totally consumed during the desulfurization of the molten iron. It is preferred, however, to compact the calcium carbide and oxidizing gas-generating solid utilizing particles of carbide having an average size of about 200–400 mesh. These particles are preferably compacted and from about 5–20T compaction pressure then sized into an article having a size of from about 8–80 mesh, preferably 10–35 mesh for use in the desulfurization process. Thus, the size of the article employed falls within that of the non-compacted carbide particles now employed commercially and existing machinery etc. can be used to dispense the articles onto the molten iron surface. Material falling outside the abovedisclosed mesh ranges can be broken down and/or recompacted. Upon generation of the oxidizing gas by the other component of the article, the article breaks down into the 200–400 mesh size carbide particles initially compacted and thus are small enough to be totally consumed by the desulfurization or oxidation reactions ocurring during the molten iron treatment.

Examples of useful oxidizing gas-generating solids useful herein include diamide lime, alkaline-earth metal carbonates such as calcium carbonate (limestone), magnesium carbonate (dolomitic lime stone) and the like.

In a preferred process, the invention disclosed herein includes the further step of nodulizing the desulfurized molten iron. Nodulizing is a well known procedure wherein magnesium and/or cerium is added to the desulfurized iron to produce spheriodal graphite therein, see Chapter I of the American Foundrymen's Society publication cited above. When nodulization of the desulfurized iron is effected, magnesium is preferably not added other than during said nodulization i.e., should not be added or present during the desulfurization step because the amount of magnesium in the nodulization step should be controlled to the extent that extraneous amounts thereof may deleteriously interfere with the nodulization process. Thus, unknown amounts thereof in the nodulization feed can so interfere with the process that large amounts of otherwise useful iron must be discarded.

The following is a typical compacting sequence for the production of articles useful in the process described herein.

For each 100 part lot, 15 parts of diamide lime are added to 85 parts of furnace grade 300 mesh calcium carbide in a suitable drum vessel equipped with mixing fins on the inner walls. The mixture is blended for 20 minutes using a drum roller and is then added to a feed hopper on a rollbriquetter where the top auger screw in the hopper is used to pre-compact the mixture before compacting between the rolls. The resulting briquettes are then cut into from 8–16 mesh size articles, the top screen on the cutter being 8 mesh and the articles passing through it being screened using a 16 mesh box filter. The resultant material is then recovered for use.

The following examples are set forth for purposes of illustration only and are not to be construed as limitations on the present invention except as set forth in the appended claims. All parts and percentages are by weight unless otherwise specified.

EXAMPLE 1

At an existing commercial iron foundry wherein calcium carbide of about 10–35 average mesh size is utilized to desulfurize molten iron, the slag, upon analysis, shows a content of 1.3% $CaC_2$. At this location undesulfurized molten metal consistantly analyzes at about 0.022% sulfur. Bags containing 17 parts of compacted additive in accordance with this invention are added to the dwell unit, one by one, whenever another transfer ladle of hot metal is brought for desulfurization. Prior to the tests conducted hereunder, the results of which are set forth hereinbelow in Table I, 25 part additions of additive consistently reduced the sulfur content of the recovered molten iron to 0.006% sulfur.

Metal samples are taken at the dwell just before the metal enters the holding furnace. Calcium carbide content of slag is measured using a wet analysis technique based upon acetylene generation upon water contact.

Hydrogen sulfide gas-generated by the water contact is scrubbed out with NaOH solution.

TABLE I

| Addition *No. | | Sulfur content of metal sample |
|---|---|---|
| 1 | added with ladle | 0.0081% |
| 2 | added with ladle | 0.0056% |
| 3 | added with ladle | 0.0020% |
| 4 | added with ladle | 0.0067% |
| 5 | added with new ladle | 0.0067% |
| 6 | added with new ladle | 0.0080% |
| 7 | added with new ladle | 0.0083% |
| 8 | added with new ladle | 0.0087% |
| 9 | added with new ladle | 0.0073% |
| 10 | added with new ladle | 0.0076% |

Final Slag Sample - % $CaC_2$ = 0.3%
no excessive slag balling noticed
*additive produced as described above.

EXAMPLE 2

Following the procedure of Example 1 additional trials are run. The results of using the compacted articles of the present invention, produced as described above, vis-a-vis the normal commercial additive (10–35 mesh powder) are set forth in Table II, below.

TABLE II

| Sample No. | Additive Identification | $CaC_2$ in Slag |
|---|---|---|
| | Trial #1 | |
| 1 | Commercial | 1.2% |
| 2 | Commercial | 5.3% |
| 3 | Commercial | 3.3% |
| 4 | Commercial | 0.2% |
| 5 | Commercial | 0.3% |
| 6 | Commercial | 6.8% |
| 7 | Compacted This Invention | 0.1% |
| 8 | Compacted This Invention | 0.0% |
| 9 | Compacted This Invention | 0.0% |
| 10 | Compacted This Invention | 0.0% |
| 11 | Commercial | 4.7% |
| 12 | Commercial | 2.9% |
| 13 | Compacted This Invention | 0.0% |
| 14 | Commercial | 0.1% |
| 15 | Commercial | 1.1% |
| 16 | Commercial | 3.3% |
| 17 | Commercial | 0.1% |
| 18 | Commercial | 0.1% |
| 19 | Commercial | 1.3% |
| 20 | Commercial | 0.3% |
| | Trial #2 | |
| 21 | Commercial | <0.05% |
| 22 | Commercial | <0.05% |
| 23 | Commercial | <0.05% |
| 24 | Compacted This Invention | 0.0% |
| 25 | Compacted This Invention | 0.0% |
| 26 | Compacted This Invention | 0.0% |
| 27 | Compacted This Invention | 0.0% |
| 28 | Compacted This Invention | 0.0% |
| 29 | Compacted This Invention | 0.0% |
| 30 | Compacted This Invention | 0.0% |
| 31 | Commercial | <0.05% |
| 32 | Commercial | 0.0% |
| 33 | Commercial | 0.0% |
| 34 | Commercial | <0.05% |

Visually, slag produced using the commercial $CaC_2$ contains large 2–3" slag balls and chunks which are difficult for the operator to "rake" from the surface. Slag produced using the compacted additive of the instant invention contains small (½") balls and is flakey and easily "raked" from the surface.

EXAMPLE 3

(Comparative)

Following the procedure of Example 1 except that the compacted calcium carbide contained only from 5–10%, by weight, of an oil to aid compaction, consistent removal of sulfur is achieved (<0.01%) however, $CaC_2$ content in the slag is not materially reduced vis-a-vis uncompacted powder as evidenced by acetylene evolution upon contact with water.

Furthermore, there is an unacceptable amount of flaming at the surface of the molten iron due to the oil in the compacted calcium carbide with some material airborne.

EXAMPLE 4

(Comparative)

The procedure of Example 1 is again followed except that the desulfurizing agent is a compacted blend of 73% calcium carbide (furnace grade) and 27% collector dust and is comprised of approximately 40% −8+10 mesh particles and 60% −10+20 mesh particles (designated hereinafter as Product A). Additive is added as 25 parts per shot. The results are set forth in Table III, below:

TABLE III

| Sample # | Desulfurizing Agent | Final Sulfur Content of Treated Iron | $CaC_2$ in Slag |
|---|---|---|---|
| 1 | Commercial | 0.0091 | 11.4% |
| 2 | Product A | 0.0096 | 9.8% |
| 3 | Product A | 0.0089 | 4.0% |
| 4 | Product A | 0.0100 | 1.9% |
| 5 | Product A | — | 0.1% |
| 6 | Commercial | 0.0093 | — |
| 7 | Product A | — | 25.0% |
| 8 | Product A | 0.0094 | 0.9% |
| 9 | Commercial | 0.0080 | 9.6% |
| 10 | Commercial | — | 22.0% |

The overall efficiencies for the commercial product and Product A are 15.0% and 17.4%, respectively. It can thus be seen that the absence of an oxidizing gas-generating component in the compacted desulfurizing agent materially detracts from its efficiency.

EXAMPLES 5–10

A series of compacted desulfurizing agents are prepared and used to desulfurize molten iron in accordance with the present invention, following basically the procedure set forth in Example I. In each instance, the compacted desulfurizing agent exhibited results substantially equivalent to those shown in Table I and II, above.

| Example No. | $CaC_2$-% | Gas-Generating Component- % | Other Component-% |
|---|---|---|---|
| 5 | 99* | $CaCO_3$-1 | — |
| 6** | 68* | Diamide Lime-10 | Collector Dust-22 |
| 7 | 84 | $MgCO_3$-8 | Collector Dust-8 |
| 8 | 55 | Diamide Lime-45 | — |
| 9 | 88 | Diamide Lime-11 | Binder Tar-1 |
| 10 | 77 | $CaCO_3$-3 | Collector Dust-20 |

*as furnace grade (85% purity)
**desulfurized iron is subsequently nodularized

We claim:

1. In a process wherein molten iron is desulfurized with a desulfurization additive by adding to only the surface of a body of the molten iron, particles of said additive in the presence of an extraneous agitating means and in the absence of a carrier gas which permeates said surface, the improvement which comprises utilizing as the additive a compacted article consisting essentially of calcium carbide and sufficient amounts of an oxidizing gas-generating solid, whereby said article is disintegrated into smaller particles which are substantially completely consumed during desulfurization of the iron and whereby the presence of residual carbide in the resultant slag is minimized.

2. A process according to claim 1 wherein said gas-generating solid is diamide lime.

3. A process according to claim 1 wherein said gas-generating solid is an alkaline earth metal carbonate.

4. A process according to claim 1 wherein said article contains from about 55 to about 99 percent, by weight, based on the total weight of the article, of calcium carbide, from about 1 to about 45 percent, weight, same basis, of said gas-generating solid and up to about 25 percent, by weight, same basis, of said calcium carbide is replace by furnace dust.

5. A process according to claim 4 wherein said gas-generating solid is diamide lime.

6. A process according to claim 4 wherein said gas-generating solid is an alkaline earth metal carbonate.

7. A process according to claim 1 wherein the size of said article ranges from about 10 to about 35 mesh.

8. A process according to claim 7 wherein said gas-generating solid is diamide lime.

9. A process according to claim 7 wherein said gas-generating solid is an alkaline earth metal carbonate.

10. A process according to claim 1 wherein said article is compacted from calcium carbide and a gas-producing solid each of which have a particle size ranging from about 200 to about 400 mesh.

11. A process according to claim 10 wherein the gas-producing solid is diamide lime.

12. A process according to claim 10 wherein the gas-producing solid is an alkaline earth metal carbonate.

13. A process according to claim 1 wherein the desulfurized iron metal is nodularized.

14. A process according to claim 13 wherein the gas-producing solid is diamide lime.

15. A process according to claim 13 wherein the gas-producing solid is an alkaline earth metal carbonate.

* * * * *